United States Patent [19]

Smith

[11] 3,965,717

[45] June 29, 1976

[54] METHOD FOR FORMING WOUND CIRCULAR MAGNETIC CORES INTO RECTANGULAR CORES

[75] Inventor: Howard S. Smith, Sharon, Pa.

[73] Assignee: Westinghouse Electric Corporation, Pittsburgh, Pa.

[22] Filed: Jan. 10, 1975

[21] Appl. No.: 540,207

[52] U.S. Cl. ..... 72/364; 29/203 L; 29/609; 148/131

[51] Int. Cl.[2] ..... B21D 31/00

[58] Field of Search ..... 29/609, 203 D, 203 L; 140/89; 148/130, 131; 266/2.5; 72/364, 456; 100/214, 230, 231

[56] References Cited

UNITED STATES PATENTS

| | | | |
|---|---|---|---|
| 1,566,603 | 12/1925 | Huber | 72/456 |
| 1,870,584 | 8/1932 | Ostrom | 72/456 |
| 2,931,993 | 4/1960 | Dornbush | 29/609 |
| 3,341,941 | 9/1967 | Olsen | 29/609 |
| 3,852,991 | 12/1974 | Poggio | 72/456 |

FOREIGN PATENTS OR APPLICATIONS

| | | | |
|---|---|---|---|
| 630,377 | 11/1961 | Canada | 29/609 |

*Primary Examiner*—Lowell A. Larson
*Attorney, Agent, or Firm*—C. L. McHale

[57] ABSTRACT

End plates are clamped around a circular magnetic core and tightened to produce two straight parallel sides. Side plates are placed adjacent to the remaining curved portions of the core. The side plates are forced together with the aid of a jack and frame structure. When the desired rectangular shape has been obtained, bolts are attached to the side plates to maintain the shape of the core until it has been annealed. The frame structure includes a pair of tracks which help to guide the side plates during the forming process.

1 Claim, 2 Drawing Figures

METHOD FOR FORMING WOUND CIRCULAR MAGNETIC CORES INTO RECTANGULAR CORES

BACKGROUND OF THE INVENTION

1. Field of the Invention:

This invention relates, in general, to forming presses and, more specifically, to magnetic core forming apparatus.

2. Description of the Prior Art:

Various arrangements have been used according to the prior art to form wound circular cores into rectangular shapes for use in power distribution transformers. U.S. Pat. Nos. 2,972,804 and 2,973,494, both of which are assigned to the assignee of this invention, illustrate magnetic cores of the type which are generally formed into a rectangular shape.

In most magnetic core forming arrangements, force is usually applied to all four sides of the magnetic core by a press which moves dies against each of the four outer surfaces of the rectangular core. While such an arrangement is economical and highly desirable from a manufacturing standpoint, it is usually necessary to have a separate set of dies dimensioned for each particular size and shape of magnetic core which is to be formed. Thus, unless a significant number of magnetic cores are to be made which have the same dimensions, it usually would not be economical to construct a set of dies so that the cores could be formed on automated or automatic pressing machinery. Therefore, it is desirable, and it is an object of this invention, to provide apparatus and a method by which a circular wound magnetic core may be formed into a rectangular core without the need for a set of expensive dies, thereby permitting the formation of a desired core shape economically for low volume production runs.

Other prior art forming arrangements have used non-automatic procedures to provide the desired rectangular shape. Most of these arrangements have made use of a press, which roughly forms the core into the desired rectangular shape, and a plurality of clamps which are applied to the roughly shaped magnetic core to more exactly shape the core into the desired rectangular shape and to maintain this shape until the core has been annealed. Such arrangements require considerable handling of the magnetic core and are susceptible to providing cores in which adjacent sides thereof are not exactly perpendicular to each other. Therefore, it is also desirable, and it is another object of this invention, to provide core forming apparatus and a method in which a minimum of core handling is required and the possibility of "parallelogramming" of the core sides is greatly reduced.

SUMMARY OF THE INVENTION

There are described herein a new and useful method and apparatus for shaping or forming a wound circular magnetic core into a rectangular core. Two pairs of end plates are clamped around opposite sides of the circular core and tightened to provide two straight and parallel sides in the magnetic core. The remaining curved portions of the magnetic core are positioned between side plates contained within a frame structure. A jack between one of the side plates and one end of the frame structure is extended to force the side plates together, thereby straightening the curved portions of the magnetic core. A spacer block is inserted into the magnetic core window area to help shape the inside surfaces of the magnetic core. The side plates are attached to each other by bolts which extend across the magnetic core and are tightened to hold the magnetic core in the same shape when the force provided by the jack is removed. The magnetic core is then annealed to relieve the stresses produced during the forming operation and to allow the removal of the end and side plates without any significant deformation of the magnetic core from the desired rectangular shape.

BRIEF DESCRIPTION OF THE DRAWING

Further advantages and uses of this invention will become more apparent when considered in view of the following detailed description and drawing, in which.

DESCRIPTION OF THE PREFERRED EMBODIMENTS

Figure 1:
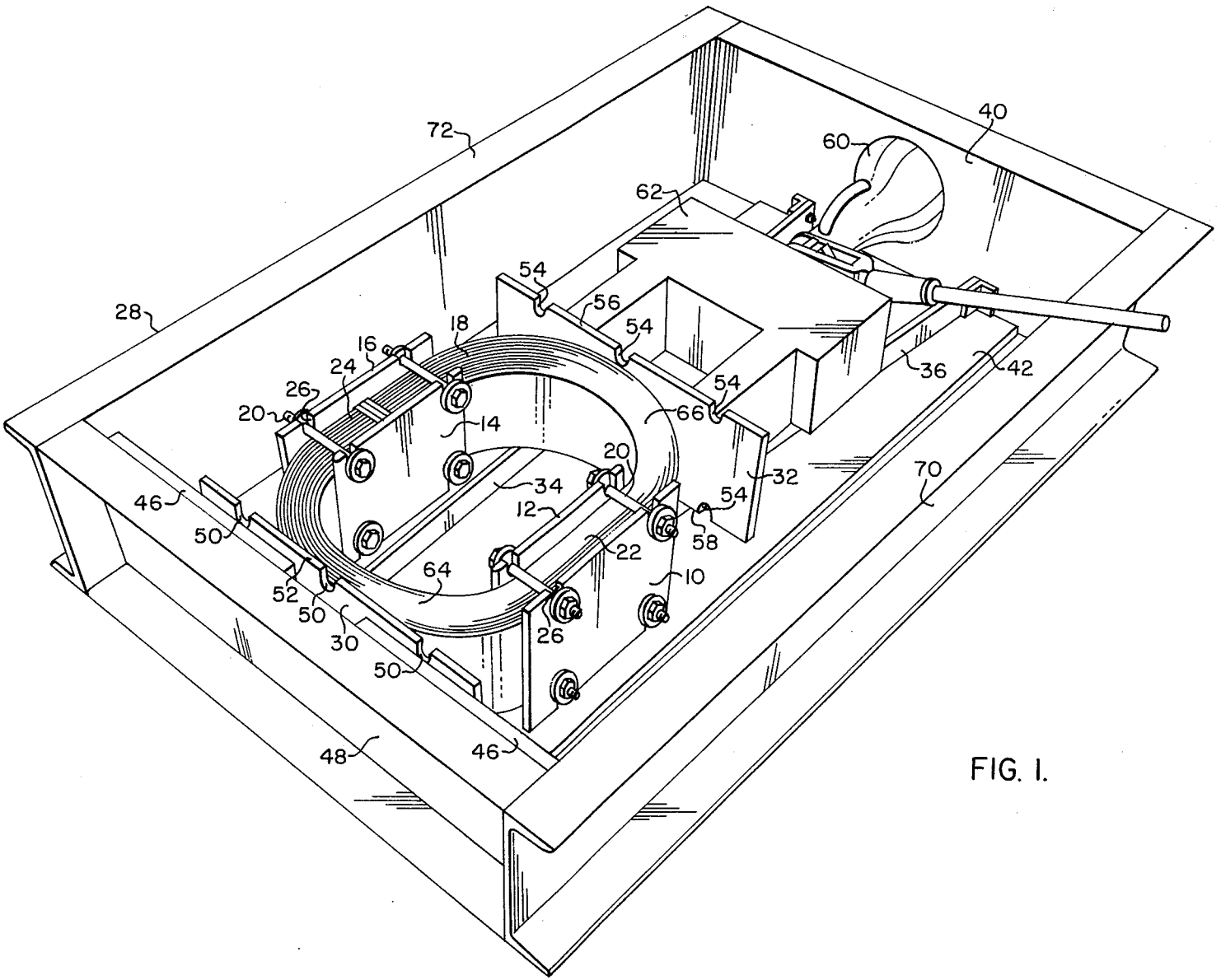
FIG. 1 is a perspective view of core forming apparatus during an intermediate stage of the core forming process.

Throughout the following description, similar reference characters refer to similar elements or members in all of the figures of the drawing.

Referring now to the drawing, and to FIG. 1 in particular, there is shown core forming apparatus constructed according to this invention. The core forming apparatus includes the end plates 10, 12, 14 and 16 which are shown already assembled around opposite portions of the magnetic core 18. The magnetic core 18 was originally circular in shape before the end plates were disposed therearound and tightened together by the bolts 20. This procedure straightens the end portions 22 and 24 of the magnetic core 18. The particular size of the end plates 10, 12, 14 and 16 is dependent upon the particular size of the magnetic core 18 which is to be formed into a rectangular shape. Thus, various sized cores would require different sized end plates to properly form the end portions of the magnetic core. The end plates also contain the slots 26 which allow convenient insertion and removal of the bolts 20. The end plates normally would be constructed of a high strength material, such as steel.

After the wound circular core 18 has its end portions 22 and 24 clamped by the end plates 10, 12, 14 and 16, it is placed into the frame structure 28 and between the side plates 30 and 32. In addition, the magnetic core 18 rests upon the tracks 34 and 36 which are used to help guide the side plate 32 when it is being moved in a direction to form the magnetic core 18. The tracks 34 and 36 are secured to the end 40 of the frame structure 28 and rest upon the bottom plate 42 of the frame structure 28, or upon the table on which the frame structure 28 is located. The other ends of the tracks 34 and 36 are not connected to the frame structure, thereby allowing the tracks 34 and 36 to be moved closer together and farther apart during the forming operation.

The side plates 30 and 32 are also dimensioned for the particular magnetic core 18 which is being formed into a rectangular shape. As with the end plates, it may be necessary that the sides plates 30 and 32 have different dimensions for different sized cores. However, only the end plates and the side plates shown in FIG. 1 require specific sizes. Thus, a plurality of different sized cores may be economically formed in the core forming apparatus without the expense of different sized dies by the use of different sized inexpensive side and end plates.

Suitable blocks 46 of wood or metal may be positioned between the side plate 30 and the end 48 of the frame structure 28 to space the side plate 30 from the end 48 to allow clearance for bolts which are to be placed in the slots 50 of the side plate 30. Although now shown in FIG. 1, the side plate 30 contains slots on the bottom edge thereof similar to the slots 50 located on the top edge 52 of the side plate 30. Similarly, the side plate 32 includes six notches 54 distributed along the edges 56 and 58.

The magnetic code 18 is positioned on top of the tracks 34 and 36 and between the side plates 30 and 32. A jack 60 and a spacing member 62 are positioned between the side plate 32 and the end 40 of the frame structure 28. The jack 60 shown in FIG. 1 is only symbolic of a mechanism required for use with the core forming apparatus. In actual use, it may be more desirable to use a hydraulic jack rather than the mechanical jack shown in FIG. 1.

To further form the core 18, the jack 60 is extended to move the block 62 toward the end 48 of the frame structure 28. This moves the side plates 30 and 32 together and further forms the side portions 64 and 66 of the magnetic core 18. As the side plates 30 and 32 are moved toward each other, the straightening of the side portions causes the end portions 22 and 24 to move farther apart. This permits the tracks 34 and 36 to be spread apart and obtain a substantially parallel relationship with each other. When this is accomplished, the notches 50 in the side plate 30 and the notches 54 in the side plate 32, which are located on the bottom edges thereof, are aligned with the tracks 34 and 36 and allow the plates 30 and 32 to be engaged with the tracks 34 and 36 for guiding the movement thereof. Thus, the side plate 32 is substantially restrained against moving at an angle with respect to the side plate 30. Therefore, "parallelogramming" during the core forming procedure is substantially eliminated.

Figure 2:
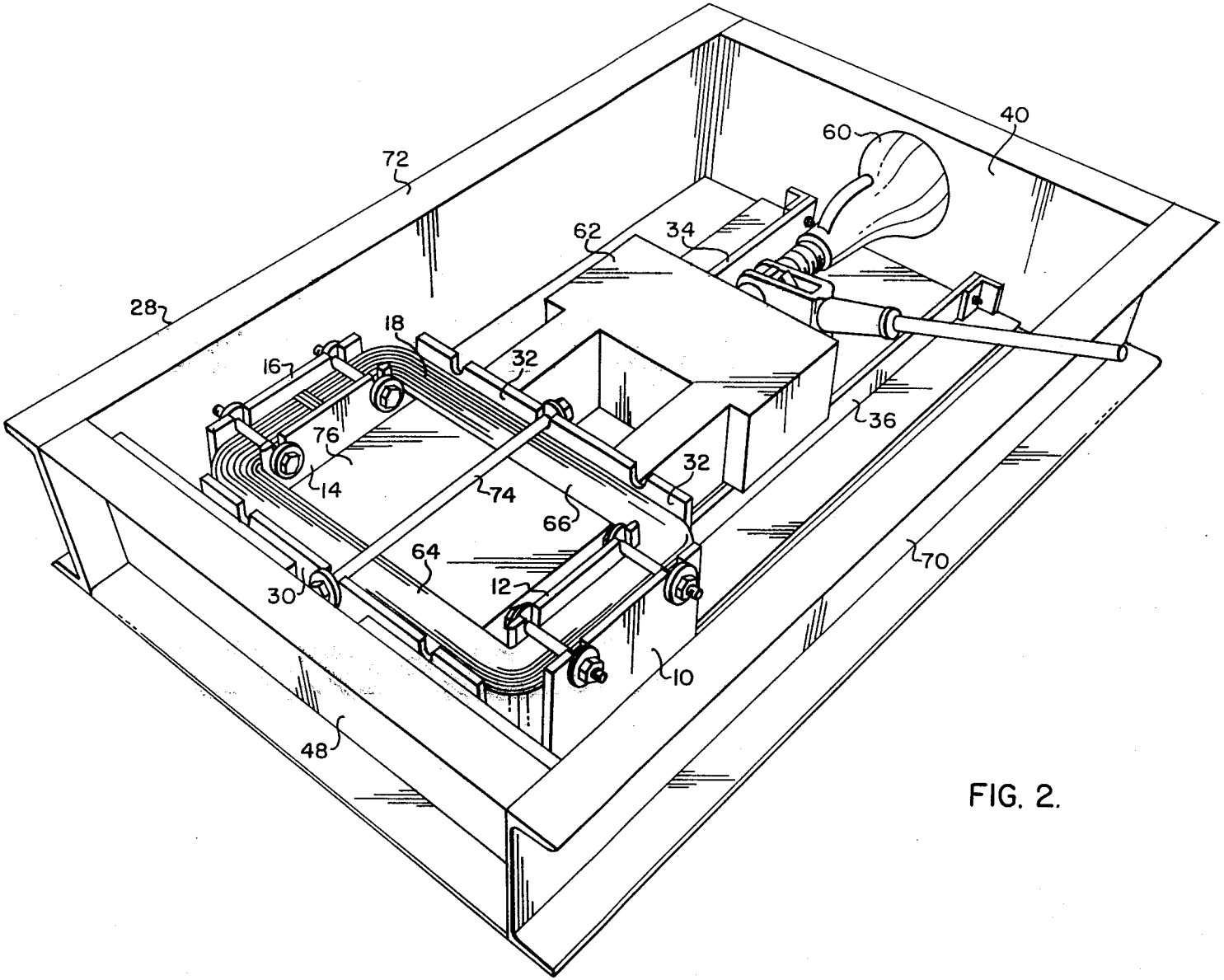
FIG. 2 is a perspective view of the core forming apparatus after the core has been completely pressed into a rectangular shape.

FIG. 2 is a view of the core forming apparatus after the jack 60 has been extended a sufficient amount to fully compress the magnetic core 18 to the desired shape. Although not shown in FIGS. 1 and 2, various spacing members may be used between the end plates 10 and 16, and between the block 62 and the sides 70 and 72 of the frame structure, to assure that the magnetic core 18 is centered within the sides 70 and 72 of the frame structure 28. After the core is fully compressed, the bolt 74 is attached to the side plates 30 and 32 as shown in FIG. 2. In addition, another bolt is similarly attached to the center notches on the bottom edges of the side plates 30 and 32. These bolts maintain the dimensions of the magnetic core 18 when the jack 60 is moved back to relieve the pressure on the magnetic core 18. Additional bolts are located in the other notches of the side plates 30 and 32 to additionally secure the dimensions of the magnetic core. The additional bolts in the notches on the bottom edges of the side plates 30 and 32 may be attached after the core is removed from the tracks 34 and 36. The spacer block 76 is positioned in the window area of the magnetic core 18 to help define the shape of the inside surfaces of the magnetic core side portions 64 and 66.

The magnetic core 18, together with the side and end plates fastened therearound and the spacer blow 76 disposed therein, is removed from the frame structure 28 and placed in a suitable heating apparatus for annealing the magnetic core laminations. After the annealing process, the side and end plates and the spacer block 76 are removed from the magnetic core. Since the stress within the laminations is relieved during the annealing process, the shape of the magnetic core 18 remains substantially rectangular as shown in FIG. 2. Thus, the magnetic core 18 has been formed into a rectangular shape by core forming apparatus which does not require expensive dies for each size of core which is formed.

Since numerous changes may be made in the above described apparatus, and since different embodiments of the invention may be made without departing from the spirit thereof, it is intended that all of the matter contained in the foregoing description, or shown in the accompanying drawing, shall be interpreted as illustrative rather than limiting.

I claim as my invention:

1. A method of forming a wound circular core having a plurality of circular laminations into a rectangular core, comprising the steps of:

placing first, second, third and fourth end plates around opposite ends of all the circular laminations in the circular core;

tightening the first and second plates together and the third and fourth plates together to form two straight and parallel ends in the complete core;

inserting the complete core between two slotted side plates which are adjacent to the remaining curved portions of the core;

inserting a spacer block into the core window;

moving the side plates together to form a rectangular core;

aligning the slotted side plates during movement thereof by a pair of tracks engaged with slots in the side plates;

attaching means to the side plates to hold the side plates together after the force which moves the side plates together is released; and annealing the core so that it will maintain its shape when the end and side plates are removed.

* * * * *